United States Patent [19]

Meyer et al.

[11] Patent Number: 4,497,633

[45] Date of Patent: Feb. 5, 1985

[54] METHOD OF FORMING A TUBULAR ELECTRICAL INSULATOR ASSEMBLY

[75] Inventors: Helmut P. Meyer; Gaston R. Isliker, both of Sidney, N.Y.

[73] Assignee: The Bendix Corporation, Southfield, Mich.

[21] Appl. No.: 396,198

[22] Filed: Jul. 8, 1982

[51] Int. Cl.[3] ..... H01T 13/20

[52] U.S. Cl. ..... 445/7; 445/49

[58] Field of Search ..... 445/7, 49; 313/131 R, 313/131 A

[56] References Cited

U.S. PATENT DOCUMENTS

| | | | |
|---|---|---|---|
| 2,684,665 | 7/1954 | Tognola | 313/131 R X |
| 3,025,425 | 3/1962 | Logan | 445/7 X |
| 3,344,304 | 9/1967 | Rademacher | 313/131 R |
| 3,558,959 | 1/1971 | Ziemendorf | 313/131 A X |
| 3,890,518 | 6/1975 | Tombs | 313/131 R |
| 3,968,303 | 7/1976 | Harris | 428/332 |
| 3,970,591 | 7/1976 | Harris | 252/521 |
| 4,144,474 | 3/1979 | Nishio et al. | 313/131 A X |
| 4,264,844 | 4/1981 | Axe et al. | 313/131 A X |

*Primary Examiner*—Kenneth J. Ramsey

[57] ABSTRACT

A method of making a tubular electrical insulator assembly for an igniter plug comprising the steps of making a recess (11) in one end of a tubular insulator (10); cementing a portion of a tubular semi-conductor (20) into the recess (11) so that the remaining portion of said semi-conductor (20) extends slightly beyond the end of said insulator (10); and grinding an annular chamfer (21) into the ends of the insulator (10) and semi-conductor (20).

3 Claims, 6 Drawing Figures

METHOD OF FORMING A TUBULAR ELECTRICAL INSULATOR ASSEMBLY

This invention relates to an igniter plug for an aircraft turbine engine and more particularly to the electrical insulator assembly within the igniter plug.

An electrically operated igniter plug has an electrical insulator separating an inner and outer electrode between which an electrical discharge is maintained. The igniter is used in a turbine engine to cause ignition of a mixture of vaporized fuel and air in the engine combustion chamber. Generally, igniters require 15,000 to 25,000 volts to cause an electrical discharge between the inner and outer electrode. However, by the use of a semi-conductive ceramic material between the inner and outer electrodes an electrical discharge may be caused by only 1,000 to 5,000 volts. The semi-conductor material between the two electrodes may be a surface coating of semi-conductor material on the electrical insulator or a solid piece of semi-conductor material. An example of an igniter plug requiring the lower voltage may be found in U.S. Pat. No. 3,970,591 entitled "Electrical Discharge Device Comprising an Insulator Body Having an Electrically Semi-Conducting Coating Formed Thereon," issued July 20, 1976.

Because it is preferable for an igniter to have a low ionization voltage so an engine may easily be restarted in the event that the combustion process stops more and more igniter plugs are being made with a solid semi-conductor between the ends of the inner and outer electrode. The semi-conductors used for such a purpose are made from ceramic material to withstand the high temperatures at the tip of the igniter. However, because of the nature of a semi-conductor, their dielectric strength is less than that of an electrical insulator, i.e., alumina. The same characteristics that make a semi-conductor have a low ionization potential to permit a discharge to occur at a low voltage also make the semi-conductor prone to failure i.e., the passage of electrical current through the semi-conductor. Once this type of failure occurs, the igniter will no longer maintain a discharge at the tip of the igniter. Accordingly, an electrical discharge throuh the semi-conductor material is a problem with igniter plugs having a solid semi-conductor material therein.

DISCLOSURE OF THE INVENTION

This invention provides a method of making an electrical insulator assembly for an igniter plug that prevents an electrical failure through the semi-conductor material located in the end portion of the igniter plug. The method is characterized by making a recess in one end of a ceramic insulator between the inner and outer electrodes and cementing in that recess a portion of a tubular semi-conductor material so that a portion of a semi-conductor is surrounded by the ceramic insulator. A chamfer is then ground into ends of the semi-conductor and insulator.

Accordingly, it is an advantage of this invention to provide an igniter plug that is less subject to electrical failure and has a longer life than previous igniter plugs having a solid semi-conductor material at the tip thereof.

It is another advantage of this invention to protect the semi-conductor portion of the tip of a igniter plug from an electrical breakdown.

DETAILED DESCRIPTION OF THE INVENTION

Figure 1:
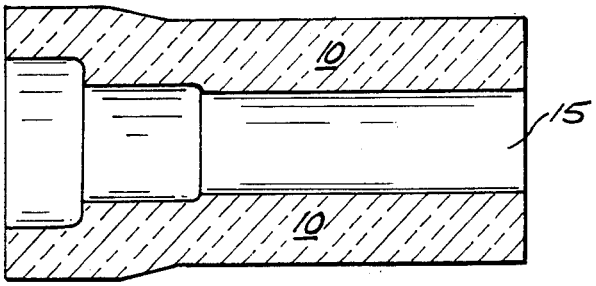
FIGS. 1 and 2 illustrate a ceramic insulator for an igniter plug.

Referring now to the drawings, FIG. 1 illustrates an electrical insulator comprised of a ceramic material such as porcelain, borosilica glass, aluminum oxide ceramics, beryillium oxide ceramics or the like. The insulator 10 has a central passage 15 therein which is adapted to receive a cylindrical electrode.

Figure 2:
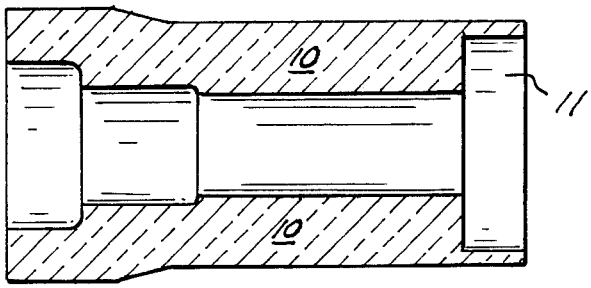

FIG. 2 illustrates a recess 11 in one end of the insulator 10.

Figure 3:
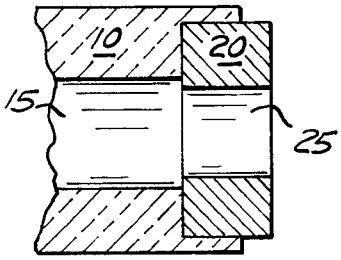
FIGS. 3 and 4 illustrate a ceramic insulator having a semi-conductor cemented to one end thereof.

FIG. 3 illustrates a solid semi-conductor 20 having a central passage 25 therein mounted in the recess of the insulator 10. Preferably, the semi-conductor 20 is cemented into the recess in the insulator 10.

Figure 4:
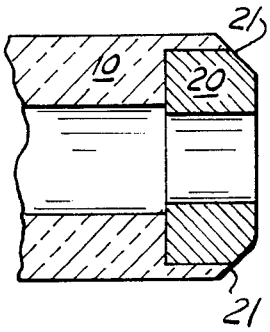

FIG. 4 illustrates an annular chamfer 21 in the ends of the insulator 10 and the semi-conductor 20.

Figure 5:
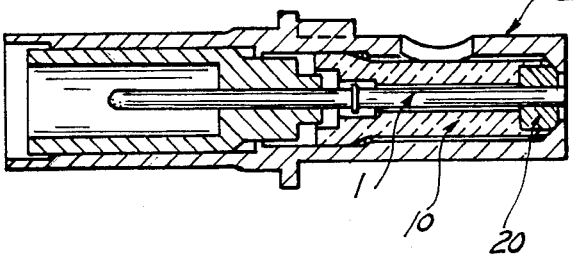
FIG. 5 illustrates an igniter plug incorporating the principles of this invention.

FIG. 5 illustrates an igniter plug incorporating the principles of the invention wherein an inner electrode 1 and an outer electrode 2 are separated by the electrical insulator 10 and semi-conductor 20.

Figure 6:
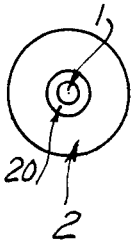

FIG. 6 is an end view of the igniter plug in FIG. 5 and illustrates the surfaces of the inner electrode 1 and outer electrode 2 between which an electrical spark or discharge is established. The surface of the semi-conductor 20 permits a voltage of 1,000 to 5,000 volts to initiate the electrical discharge.

Referring now to FIGS. 1 through 4, a method of forming the tubular insulator assembly for an igniter plug includes the step of making a recess 11 in one end of the tubular insulator 10; placing a tubular semi-conductor 20 into the recess 11 so that the semi-conductor is surrounded by a portion of the tubular insulator 10; grinding an annular chamfer 21 into the end of the insulator and semi-conductor; inserting the tubular insulator assembly into the outer electrode 2 of the igniter plug; and inserting the inner electrode into the central passage 15 and 25 of the insulator 10 and semi-conductor 25. Preferably, the semi-conductor 20 is cemented into the recess 11 in the insulator 10. The extension of the insulator 10 around the semi-conductor increases the dielectric strength of the insulator between the inner and outer electrode.

While a preferred embodiment of this invention has been disclosed, it will be apparent to those skilled in the art, the changes may be made to the invention as set forth in the appending claims, and in some instances, certain features of the invention may be used to advantage without corresponding use of other features. Accordingly, it is intended that the illustrative and descriptive materials herein be used to illustrate the principles of the invention and not to limit the scope thereof.

Having described the invention, what is claimed is:

1. A method of forming a tubular electrical insulator assembly for an igniter of the type having an inner electrode coaxially arranged with an outer tubular electrode and separated by said tubular electrical insulator assembly, said method comprising:

making a recess in one end of the tubular insulator;

placing at least a portion of a tubular semi-conductor into said recess; and grinding an annular chamfer into the ends of said insulator and said semiconductor to form a conical surface extending across the junction of said insulator and semiconductor.

2. The method as recited in claim 1 including the step of cementing said semiconductor into the recess in said insulator.

3. The method as recited in claim 1 or 2 including the step of inserting said insulator assembly into the outer tubular electrode and inserting the inner electrode into the central passage of said tubular insulator assembly.

* * * * *